US011427942B2

(12) United States Patent
Keck et al.

(10) Patent No.: US 11,427,942 B2
(45) Date of Patent: Aug. 30, 2022

(54) NON-PLANAR NONWOVEN FABRICS AND METHODS OF MAKING THE SAME

(71) Applicant: Kimberly-Clark Worldwide, Inc., Neenah, WI (US)

(72) Inventors: Laura E. Keck, Alpharetta, GA (US); John H. Conrad, Alpharetta, GA (US); Susan E. Shawver, Buford, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 510 days.

(21) Appl. No.: 16/338,474

(22) PCT Filed: Sep. 29, 2017

(86) PCT No.: PCT/US2017/054544
§ 371 (c)(1),
(2) Date: Mar. 30, 2019

(87) PCT Pub. No.: WO2018/064595
PCT Pub. Date: Apr. 5, 2018

(65) Prior Publication Data

US 2021/0277557 A1 Sep. 9, 2021

Related U.S. Application Data

(60) Provisional application No. 62/402,071, filed on Sep. 30, 2016.

(51) Int. Cl.
*D04H 3/07* (2012.01)
*D04H 3/11* (2012.01)

(52) U.S. Cl.
CPC ..... *D04H 3/07* (2013.01); *D04H 3/11* (2013.01)

(58) Field of Classification Search
CPC ..... D04H 3/07; D04H 3/11
USPC ..... 428/180
See application file for complete search history.

(56) References Cited

U.S. PATENT DOCUMENTS

| | | | | |
|---|---|---|---|---|
| 5,385,036 | A | 1/1995 | Spillane et al. | |
| 5,575,874 | A * | 11/1996 | Griesbach, III | A61F 13/512 156/167 |
| 6,231,940 | B1 | 5/2001 | Aichner et al. | |
| 2004/0173274 | A1 | 9/2004 | Onikubo et al. | |
| 2005/0159065 | A1 | 7/2005 | Stralin et al. | |
| 2005/0238842 | A1 | 10/2005 | Schindzielorz et al. | |
| 2007/0059496 | A1 | 3/2007 | Russell et al. | |
| 2007/0207691 | A1 | 9/2007 | Cobbett Wiles et al. | |
| 2007/0209770 | A1 | 9/2007 | Barrett et al. | |

(Continued)

FOREIGN PATENT DOCUMENTS

| | | | |
|---|---|---|---|
| DE | 102012007894 | A1 | 11/2013 |
| EP | 1059159 | B1 | 5/2004 |

(Continued)

*Primary Examiner* — Brent T O'Hern

(57) ABSTRACT

The present invention provides a method of making a nonwoven fabric of continuous fibers that includes forming a nonwoven web on a highly porous woven or knitted forming fabric that defines a pattern of recesses that are bordered by spaced apart filaments extending between the outer surfaces of the fabric and that allows air to pass both downwardly and sidewardly through the forming fabric. Bonded nonwoven webs are formed having protrusions with very low density and high surface area.

20 Claims, 10 Drawing Sheets

(56) References Cited

U.S. PATENT DOCUMENTS

| | | | | |
|---|---|---|---|---|
| 2011/0162239 | A1 | 7/2011 | Bier et al. | |
| 2013/0220475 | A1* | 8/2013 | Barrett | D21F 11/006 139/383 A |
| 2015/0343337 | A1 | 12/2015 | Willuweit et al. | |

FOREIGN PATENT DOCUMENTS

| | | | |
|---|---|---|---|
| GB | 2292526 | A1 | 2/1996 |
| GB | 2468905 | A1 | 9/2010 |
| WO | 06100434 | A1 | 9/2006 |
| WO | 2012006300 | A1 | 1/2012 |

* cited by examiner

NON-PLANAR NONWOVEN FABRICS AND METHODS OF MAKING THE SAME

This application claims the benefit of priority from U.S. Provisional Application No. 62/402,071 filed on 30 Sep. 2016, the contents of which are incorporated herein by reference.

FIELD OF INVENTION

The present invention relates to methods of making non-planar nonwoven fabrics having shaped and/or three-dimensional structures therein.

BACKGROUND

A wide variety of articles in use today are partially or wholly constructed of nonwoven fabrics. Specific examples of such products include, but are not limited to, diapers, feminine pads, baby wipes, hard surface wipes, filters, face masks, bandages, tarpaulins, and so forth. For these articles nonwoven fabrics cost effectively provide one or more different key functional properties such as liquid intake and distribution, particle capture, strength, hand-feel, and aesthetics.

Nonwoven fabrics have a physical structure of individual fibers which are interlaid in a generally random manner rather than in a regular, identifiable manner such as in knitted or woven fabrics. Conventional nonwoven fabrics are formed on a forming wire or drum and have a generally flat, planar shape. However, in order to create nonwoven fabrics having a non-planar shape, such as having a pattern of protuberances, it is known to deposit nonwovens on to a forming surface having a series of projections or apertures so that the webs conform to and take the shape of the forming surface. For example, U.S. Pat. No. 5,575,874 to Griesbach et al. describes a method of making shaped nonwoven fabrics having discrete raised ridges, columnar structures and other shapes by forming the nonwoven web onto a forming surface with the desired topography. However, Griesbach and other such methods have often employed simple forming structures such as those comprising a rubber mat with cut out sections or a wire mesh with solid components attached thereto. The use of such structures is limiting in terms of the available size and/or shape of the projections and further can create significant problems with respect to web formation and runability. Further, such forming surfaces suffered from the creation of non-planar fabrics often lacking in strength, uniformity and/or other attributes. For example, nonwoven webs formed with such formation surfaces often resulted in an excessive amount of the fiber being pushed outside a protruding structure or drawn into a recessed structure as a result of the uneven air-flow caused by the forming surface.

Consequently, there remains a need for a nonwoven fabric production process that provides nonwoven webs having relatively larger and/or more closely spaced non-planar structures as well as nonwoven webs having an improved balance of material properties including for example, improved uniformity, strength, softness, appearance and/or other attributes. Further, there exists a need for methods of manufacturing such non-planar nonwoven webs that allow for a greater variety of fabric shapes and a highly efficient and/or economical means of manufacturing the same.

SUMMARY OF THE INVENTION

The present invention provides a method of making a nonwoven fabric that includes depositing continuous air-entrained filaments on a fibrous forming fabric that has an outer forming surface comprising first land areas that define a plurality of openings. The openings can each have a minimum area greater than about 12 $mm^2$ and collectively comprise at least 40% of the total area of the outer forming surface. The first land areas may, in certain embodiments, comprise entwined first filaments and extend predominantly in a first plane. The fibrous forming fabric further includes an opposed second outer surface comprising second land areas. The second land areas may similarly comprise entwined filaments and extend predominantly in a second plane parallel to the first plane. The fibrous forming fabric further includes a foraminous interior area located between the first and second land areas. The interior area has a thickness greater than 2.3 mm and includes filaments extending downwardly from the first land areas to the second land areas. The interior filaments inter-connect with and/or are entwined with the filaments in the first and second land areas. In addition, at least a portion of the interior filaments extend downwardly adjacent the first openings thereby defining recesses located between the first and second land areas. The interior filaments are desirably spaced apart from one another so as to allow both the downward and sideward flow of air through the interior area and/or recesses. The outer surfaces and interior areas are all foraminous and provide a forming fabric having an air porosity of at least 500 CFM.

In a further aspect, the method includes the steps of (a) entraining the plurality of continuous fibers in a stream of air; (b) moving the fibrous forming fabric under the stream of air and entrained filaments; (c) suctioning the entraining air through the fibrous forming fabric from adjacent the second outer surface; (d) depositing the entrained fibers onto the first land areas of the fibrous forming fabric and into the recesses; (e) forming inter-fiber bonds between the deposited fibers; and then (f) removing the nonwoven web from the fibrous forming surface.

In addition, bonded high-loft nonwoven webs are also provided having a pattern of projections separated by at least one land area and that comprise autogenously bonded continuous fibers. The projections comprise greater than 50% of the area of the nonwoven web and the land areas comprise less than 50% of the area of the nonwoven web and the average height of the projections is at least twice the average thickness of the land area. Further, each projection has a minimum area greater than 12 $mm^2$ and a density less than about 0.03 g/cc. In addition, in certain embodiments, the despite the low density, the average basis weight of the land areas is not less than about 40% of the average basis of the projections. Further, the projections may each have an area of between about 20-2000 $mm^2$ and the land areas may have a width, as measured between adjacent projections, of less than about 5 mm.

DETAILED DESCRIPTION

Figure 1:
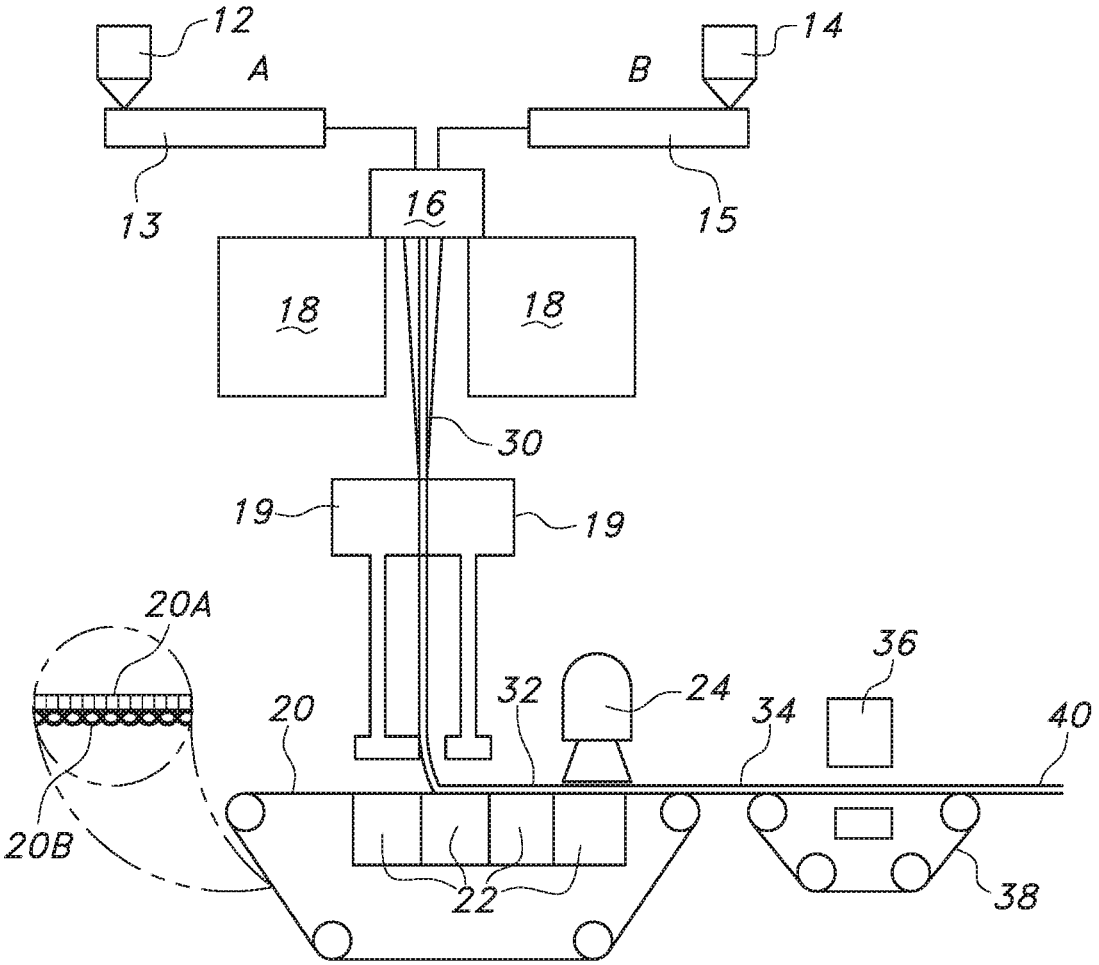
FIG. 1 is a schematic illustration of a system for forming a non-planar spunbond web of the present invention.

Throughout the specification and claims, discussion of the articles and/or individual components thereof is with the understanding set forth below.

The term "comprising" or "including" or "having" are inclusive or open-ended and do not exclude additional unrecited elements, compositional components, or method steps. Accordingly, the terms "comprising" or "including" or "having" encompass the more restrictive terms "consisting essentially of" and "consisting of."

As used herein the term "nonwoven web" generally refers to a web having a structure of fibers that are interlaid, but not in an identifiable and repeating manner as in a woven or knitted fabric.

As used herein the term "cellulosic" means those materials comprising or derived from cellulose including natural or synthetic cellulose as well as that derived from both woody and non-woody sources.

As used herein "continuous fibers" means fibers formed in a continuous, uninterrupted manner having a high aspect ratio (length to diameter) in excess of 10,000:1 and an uncontracted length in excess of 100 cm. In the context of an individual article having dimensions less than 100 cm, continuous fibers includes those fibers that extend continuously within the article.

As used herein "staple fibers" or "staple length fibers" means continuous synthetic fibers cut to length or natural fibers, such fibers having a length between about 0.5 mm and about 90 mm. The length of such fibers being that of the straight (e.g. uncontracted) fiber.

As used herein, the terms "machine direction" or "MD" generally refers to the direction in which a material is produced.

As used herein, the terms "cross-machine direction" or "CD" generally refers to the direction perpendicular to the machine direction.

As used herein, the term "autogenous bonding" refers to bonding between discrete parts and/or surfaces of fibers independently of external additives such as adhesives, solders, mechanical fasteners and the like. In other words, the bond is formed by one or more of the polymers forming the fiber itself.

A wide variety of thermoplastic polymer compositions are believed suitable for use in connection with the present invention. By way of non-limiting example, suitable thermoplastic polymers include polyesters (e.g., polylactic acid, polyethylene terephthalate, etc.); polyolefins (e.g., polyethylene, polypropylene, polybutylene, etc.); polytetrafluoroethylene; polyvinyl acetates; polyvinyl chloride acetates; polyvinyl butyrals; acrylic resins (e.g., polyacrylate, polymethylacrylate, polymethylmethacrylate, etc.); polyamides (e.g., nylon); polyvinyl chlorides; polyvinylidene chlorides; polystyrenes polyvinyl alcohols; polyurethanes; and blends and combinations thereof. In one embodiment, for instance, the thermoplastic composition may comprise a polyolefin composition including greater than 50 weight percent polyolefin such as between about 51 to 99 weight percent, 60 to 98 weight percent, or even 80 to 98 weight percent of the thermoplastic composition. Suitable polyolefins include, for example, homopolymers, copolymers and terpolymers of ethylene (e.g., low density polyethylene, high density polyethylene, linear low density polyethylene, etc.), propylene (e.g., syndiotactic, atactic, isotactic, etc.), butylene and so forth. The polymer composition may comprise a homopolymer or homogeneous or non-homogeneous blends of two or more thermoplastic polymers. Further, as is known in the art one or more additives may added to the thermoplastic polymer composition including for example, adding one or more tackifiers, fillers, colorants (e.g. $TiO_2$), antioxidants, softening agents, surfactants, slip agents and so forth.

The fibers formed from the thermoplastic polymer compositions may comprise either monocomponent, multiconstituent or multicomponent fibers. Multicomponent fibers include polymer compositions that may be arranged in substantially constantly positioned distinct zones across the cross-section of the fibers and are generally formed from two or more polymer compositions (e.g., bicomponent fibers) extruded from separate extruders but spun together. The components may be arranged in any desired configuration, such as sheath-core, eccentric sheath-core, side-by-side, pie, island-in-the-sea or various other arrangements known in the art. In certain embodiments, the fibers may comprise polypropylene/polyethylene or polyethylene/polyamide multicomponent fibers having a side-by-side or eccentric sheath/core configuration. Multiconstituent fibers refers to fibers which have been formed from at least two polymers extruded from the same extruder as a mixture. In multiconstituent fibers the various polymers are usually not continuously positioned along the length of the fiber, instead usually forming fibrils or protofibrils which start and end at random. By way of example only, various methods for forming multicomponent and multiconstituent fibers include, but are not limited to, those described in U.S. Pat. No. 4,795,668 to Krueger et al., U.S. Pat. No. 5,108,820 to Kaneko et al., U.S. Pat. No. 5,162,074 to Hills, U.S. Pat. No. 5,336,552 to Strack et al., U.S. Pat. No. 5,382,400 to Pike et al. and US2001/0019929 DeLucia et al.

Nonwoven fabric forming processes suitable for use in connection with the present invention include those that utilize air to entrain and deposit continuous fibers onto a forming surface. Prior to entrainment the polymer composition forming the fibers is melted and extruded via a spinneret, spin pack, die or like apparatus. Various processes for pneumatically entraining the continuous fibers are known in the art and believed suitable for use in connection with the present invention. In one aspect, the nonwoven fabric may be formed by meltblown web processes which generally refer to those that form the nonwoven web by a process in which a molten thermoplastic material is extruded through a plurality of fine, usually circular, die capillaries as molten fibers into converging high velocity gas (e.g. air) streams that attenuate the fibers of molten thermoplastic material to reduce their diameter. Thereafter, the meltblown fibers are carried by the high velocity gas stream and are deposited on a collecting surface to form a web of randomly dispersed meltblown fibers. By way of non-limiting example, meltbown fiber nonwoven webs and processes for making the same are disclosed in U.S. Pat. No. 3,849,241 to Butin, et al.; U.S. Pat. No. 4,775,582 to Abba et al., U.S. Pat. No. 4,707,398 to Wisneski, et al.; U.S. Pat. No. 5,652,048 to Haynes et al, U.S. Pat. No. 6,972,104 to Haynes et al. and so forth.

Coformed materials are also particularly well suited for use in the present invention. Coform nonwoven webs are formed by comingling continuous fibers and staple-length fibers in a common airstream before they are deposited onto a forming surface. Examples of such coform sheets materials, and methods of making the same, are described U.S. Pat. No. 4,100,324 to Anderson et al., U.S. Pat. No. 5,350,624 to Georger et al., U.S. Pat. No. 6,972,104 to Harvey et al and U.S. Pat. No. 9,260,808 to Schmidt et al. In certain embodiments such coform sheets can comprise air-formed matrix of thermoplastic polyolefin meltblown fibers and staple length cellulosic fibers such as wood pulp fibers. In certain other embodiments such coform sheets can comprise air-formed matrix of thermoplastic polyolefin spunbond fibers and staple length cellulosic fibers such as wood pulp fibers. In order to limit fouling of the forming fabric and/or nonwoven breaks, the conformed nonwoven webs can have outer surfaces that predominantly comprise the continuous thermoplastic fibers whereby the majority of staple fibers are located within the interior of the deposited matt of fibers and the resulting coherent nonwoven web. In a further aspect, the staple fibers may be non-thermoplastic and/or have a melting temperature significantly higher than that of the continuous fibers, desirably being at least 10° C., 15° C., 20° C. or even 30° C. higher than that of the continuous fibers, or in the case of multicomponent continuous fibers higher than the lowest melting polymeric composition forming an outer portion of the continuous fibers. In the case of such heterogenous fiber webs, the continuous fibers desirably comprise greater than about 55%, 60%, 65%, 70% or 80% of the fibers forming the nonwoven web.

In still further embodiments, the fibers forming the nonwoven web may be formed and deposited using melt-spun nonwoven web processes. In one aspect, spunbond fiber nonwoven webs are well suited for use in connection with the present invention. Spunbond nonwoven webs comprise continuous fibers formed by extruding a molten thermoplastic polymer composition from a plurality of fine, usually circular, capillaries as molten threads into converging high velocity hot air streams which attenuate the filaments of molten thermoplastic material to reduce their diameter. The reductive drawing of the spunbond process also acts to impart a degree of crystallinity to the formed polymeric fibers which provides a web with relatively increased strength. By way of example only, the production of spunbond webs is described in U.S. Pat. No. 4,340,563 to Appel et al, U.S. Pat. No. 5,382,400 to Pike et al., U.S. Pat. No. 8,246,898 to Conrad et al. and U.S. Pat. No. 8,333,918 to Lennon et al. In certain embodiments, a crimp may be formed in the fibers such that the nonwoven web comprises crimped spunbond fiber webs. In addition, as is known in the art, sequential banks of spunbonding apparatus may be employed over the forming fabric in order to achieve nonwoven webs having higher basis weights and/or incorporate different types of fibers. In this regard, it is noted that the use of two or more sequential banks of spunbond to deposit fibers over the forming fabric is generally preferred. In certain embodiments, the fibers within the nonwoven web can consist of continuous fibers. For example, in a particular embodiment, the fibers comprising the nonwoven web may entirely consist of spunbond fibers.

By way of example only, one embodiment of a pneumatic process for forming and depositing fibers in connection with the present invention is shown in FIG. 1. Although by no means required, the process shown in FIG. 1 is configured to form bicomponent continuous fibers having a side-by-side configuration. More particularly, polymer compositions A and B are initially supplied from hoppers 12 and 14 to melt extruders 13, 15 and then to a common spin pack 16 to form bicomponent fibers 30.

The two polymer streams are brought together prior to or within the spinneret and extruded together through the same orifice of the spinneret to form a single multi-component fiber. Molten strands exit the spinnerert and the fibers 23 are initially quenched and solidified by blowers 18. The fibers 18 are then directed into and through a fiber draw unit 19 which acts to further attenuate the fibers. The drawn fibers may then be deposited on a circumrotating moving forming structure 20; the forming structure 20 comprising an upper fibrous forming member 20*a* and a lower support member 20*b*. Additional details regarding the forming structure 20 is provided herein below. Deposition of the fibers 30 is aided by a vacuum supplied by a suction boxes 22 positioned under the forming structure 20. The suction boxes help pull down the fibers 30 onto the forming fabric 20*a* and remove draw air in order to prevent it from dislodging or otherwise interfering with the laid fibers. The forming structure 20 is porous so that downward air flow associated with the suction box 22 causes the fibers to be deposited upon and generally conform to the forming fabric 20*a*.

In certain embodiments such as in relation to the production of spunbond fiber webs, when deposited onto the forming structure 20 the fibers 30 may initially form a loose matt 32 with little structural integrity. While the fibrous matt 32 remains on the forming structure 20, the loose matt 32 of deposited fibers 30 is treated in a manner to form points of attachment or bonds at fiber-to-fiber contact points and thereby provide a coherent nonwoven fabric 34 with the integrity required to retain its three-dimensional shape for further processing and/or its intended use. In one aspect, the deposited fibers may be treated by through-air bonder 24 which includes the passing of heated air through the fibers in order to cause enough softening and flow of exposed polymer (i.e. forming the outer portion of the fibers) so as to form a bond with adjacent fibers. However, care is taken so as not to apply heated air at such a temperature and duration so as to cause softening to the extent that the form and shape of the fibers significantly degrades or that excessive bonding is generated as between the continuous fibers and the forming fabric. A particular device capable of delivering a focused stream of high-velocity air for quickly forming inter-fiber bonds without the loss of fiber shape and structure is described in U.S. Pat. No. 5,707,468 to Arnold et al.

Briefly, the through-air bonder utilizes a focused stream of heated air at a high linear flow rate onto the deposited nonwoven. For example, the linear flow rate of the stream of heated air may be in a range of from about 300 to about 3000 meters per minute and the temperature of the stream may be in a range of from about 90° C. to about 290° C. Higher temperatures may be used, depending upon the melting point of the polymer employed as the outer portion or component of the thermoplastic polymer fibers present in the web. The stream of heated air is arranged and directed by at least one slot which typically has a width of from about 3 to about 25 mm and is oriented in a substantially cross-machine direction over substantially the entire width of the web at height of from about 6 to about 254 mm above the surface of the web. A plurality of slots may be employed, if desired, and they may be arranged next to or separate from each other. The at least one slot may be continuous or discontinuous and may be composed of closely spaced holes. The through-air bonder has a plenum to distribute and contain the heated air prior to exiting the slot. The plenum pressure of the air usually is from about 2 to about 22 mm Hg. In addition, it is noted that the air temperature, duration and speed can be selected to achieve inter-fiber bonding and also to activate any latent crimp that may have been imparted to the fibers such as is commonly achieved with certain configurations of bicomponent fibers.

After being initially bonded upon the forming fabric, the non-planar nonwoven web 34 can be separately bonded again after removal from the forming fabric in order to increase the overall integrity and/or durability of the shaped nonwoven web. The additional bonding can also increase the resiliency of the projections extending out of the base plane of the web. By way of example, the non-planar nonwoven web 34 may be directed to a through-air bonded 36 which acts to further increase the number and/or durability of bonds formed between fibers, forming a stronger more durably bonded non-planar nonwoven web 40. It is believed that multi-step bonding, where the initial bonding step is limited, helps reduce the risk that the nonwoven web will bond to and/or foul the forming fabric. The degree of bonding will vary with the particular end use. In this regard, as is known in the art, excessive bonding is to be avoided where properties such as drape, hand and softness are particularly desired.

In alternate embodiments, fiber-to-fiber bonds may be formed by other means known in the art such as by an applied bonding agent or adhesive. For example, the adhesive may be applied by spraying, slot coating, rotogravure and so forth. Vacuums applied under the nonwoven matt and forming structure may be applied to draw the adhesive through the desired thickness of the matt. Thereafter, the adhesive can be cooled or activated such as by the application of heat or other energy. In the case of a conventional latex binder, the latex may be dried by the application of heat.

As indicated above, the forming structure includes a forming fabric and, optionally, a support member. The forming fabric, either alone or in combination with the support member, is foraminous and desirably flexible, i.e. capable of being repeatedly and readily bent. The forming surface will generally comprise a continuous loop such that the forming surface can be positioned under and continuously rotated beneath the air entrained fibers. The continuous flow of air entrained fibers are deposited on the moving forming surface thereby forming a nonwoven matt with the fibers generally oriented in the MD.

The desirability of employing a support member will depend on the specific materials selected for the forming fabric and in particular the relative tensile strength of the same. When utilized, the support member can comprise one or more different materials including, by way on non-limiting example, a wire, belt or drum. In this regard, the support member can itself be a conventional wire or belt suitable for the deposition and formation of substantially planar nonwoven fabrics. Suitable support members include, but are not limited to, those available from Albany International of New Hampshire, USA. The support member may, in one aspect, comprise a woven or stitched belt. The support member is foraminous and, when used, will have an air permeability of at least 400 CFM and including for example between about 400-900 CFM or between about 500-700 CFM. The forming fabric and support member may be attached to one another by one or more means known in the art including, for example, sewing, stitching, clamping, tying, gluing and so forth. Desirably the forming fabric is releasably attached to a support member, such that it can be readily changed or replaced separate from the support member.

The forming fabric comprises a highly porous and bulky woven or knitted material. In reference to FIGS. 2A, 2B and 2C, the forming fabric 100 comprises a first major outer surface or forming surface 101 that includes first land areas 102. The first land areas 102 are themselves formed by a plurality of entwined first filaments 104. The first land areas extend continuously along the length (MD) of the forming fabric, across the width (CD) of the forming fabric, or continuously along and across both the length and width of the forming fabric. In reference to the forming fabric 100 in FIG. 2A, the first land areas extend continuously across both the lengthwise (or MD) and widthwise (or CD) dimensions in a first, single plane. The first land areas 102 define discrete open areas 106A, 106B within the first plane of the fabric. The open areas within the first major outer surface of the forming fabric desirably comprise a significant portion of the exposed surface area and even more desirably comprises the majority of the exposed surface area. Openings can comprise at least about 40%, 45%, 50%, 55%, 60% or even 65% of the first major outer surface and in a further aspect can comprise less than about 95%, 90% or even 85% of the first major outer surface. Correspondingly, the first land areas can comprise at least about 5%, 10%, or 15% of the first major outer surface and/or can comprise less than about 60%, 55%, 50%, 45%, 40% or even 35% of the first major outer surface. The first land areas can have an average width (as defined between immediately adjacent open areas) of between about 0.8 mm and about 9 mm. In certain embodiments the land areas may have a width greater than about 0.8 mm, 1 mm, or even 2 mm and/or less than about 8 mm, 7 mm or even 6 mm. The present invention allows, advantageously, utilizing a high degree of open area in the forming fabric which results in a corresponding high percentage of shaped elements in the nonwoven fabrics formed thereon. The individual open areas 106 can have an area greater than about 12 $mm^2$, 20 $mm^2$, 40 $mm^2$, 50 $mm^2$, 75 $mm^2$ or even 100 $mm^2$ and/or have an area less than about 2000 $mm^2$, 1500 $mm^2$, 1000 $mm^2$, 750 $mm^2$ or even 500 $mm^2$. In certain embodiments, the opening may have a smallest dimension (as measured between opposed land areas that define the opening) greater than about 3 mm, 5 mm, 8 mm, 10 mm or even 15 mm and/or have a largest dimension less than about 60 mm, 55 mm, 50 mm, 45 mm, 40 mm, 35 mm or even 30 mm.

Figure 2A:
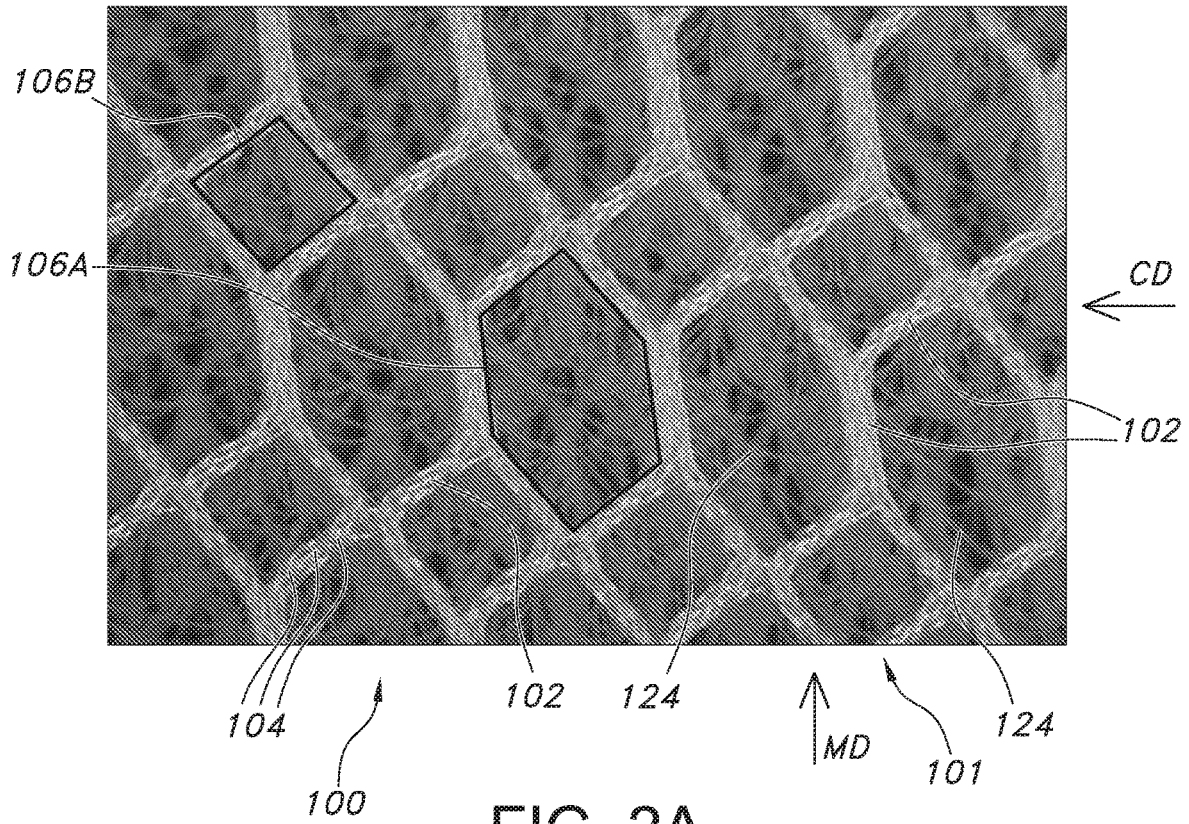
FIG. 2A is a top view of a forming fabric suitable for use in the present invention.
Figure 2B:
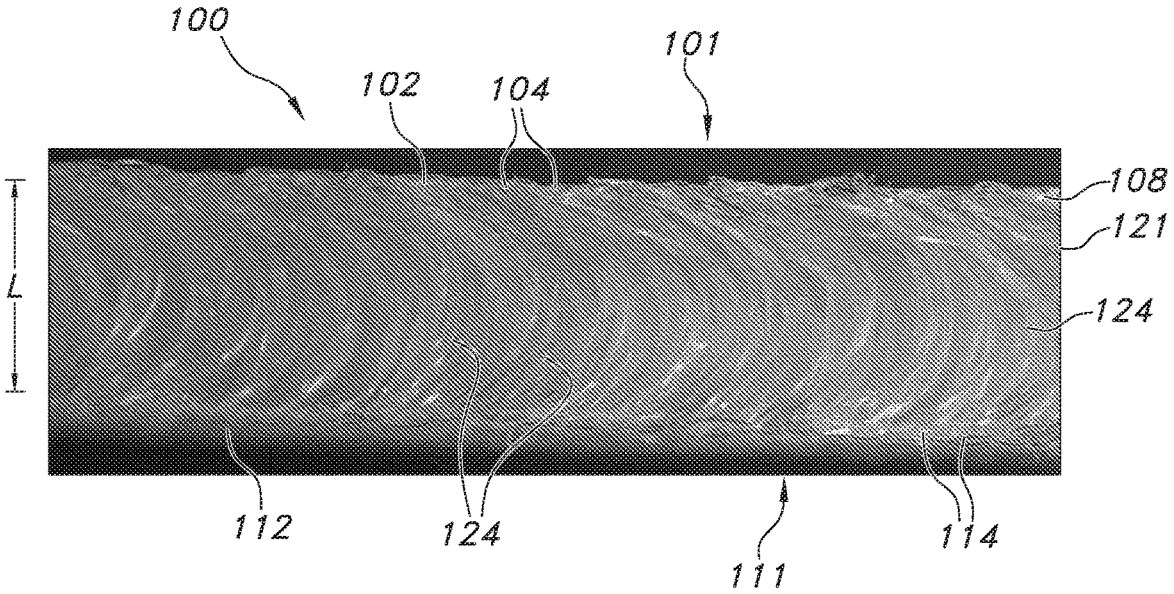
FIG. 2B is side view of the forming fabric of FIG. 2A.
Figure 2C:
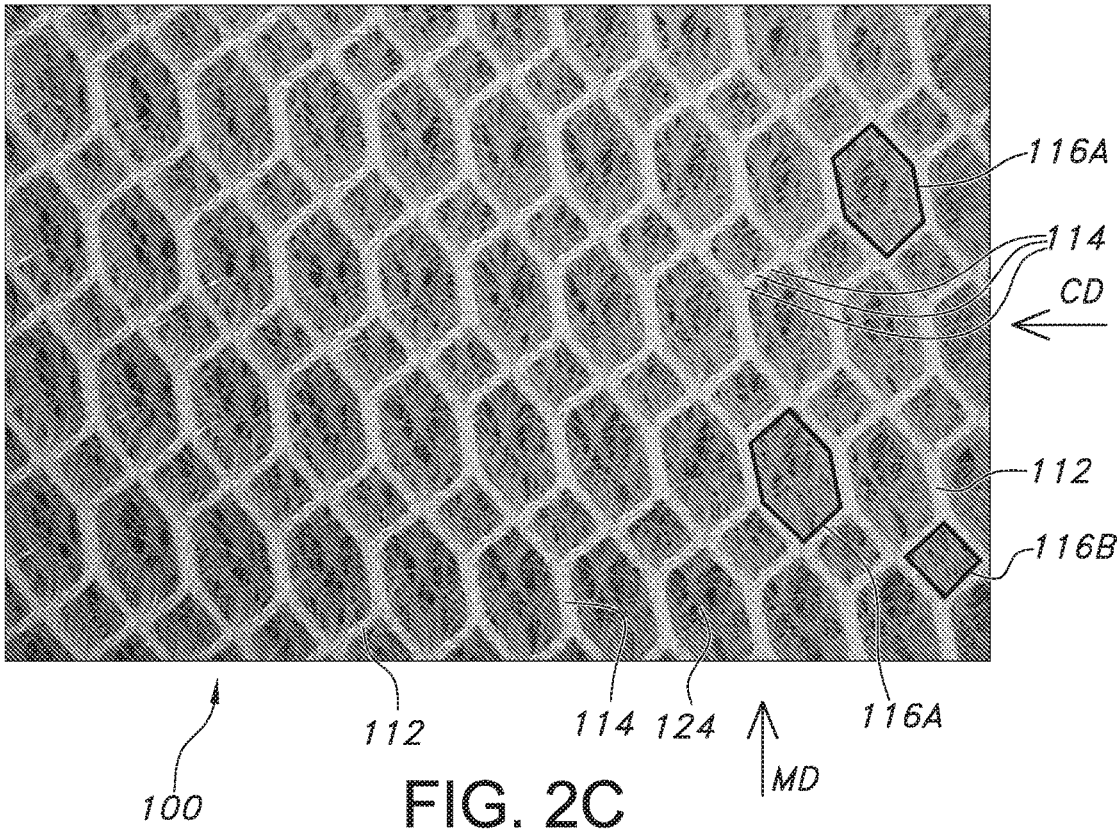
FIG. 2C is a bottom view of the forming fabric of FIG. 2A.

In reference to FIGS. 2B and 2C, the forming fabric 100 includes a second major outer surface 111 opposite and substantially parallel to the plane of the first major surface 101. The second major outer surface 111 includes second land areas 112. The second land areas 112 are formed by a plurality of entwined second filaments 114 and extend substantially in the plane of the second major surface 111.

The second land areas can extend continuously along the length (MD), the width (CD), or both the length and width of the forming fabric. In reference to the forming fabric 100 in FIG. 2C, the second land areas 112 extend continuously across both the lengthwise (MD) and widthwise (CD) dimensions in a second, single plane that is parallel to the first plane. The second land areas 112 define a pattern of second open areas 116. The second land areas 112 and second open areas 116 may have dimensions comparable to those discussed above in relation to the first land areas 102 and first open areas 106 of the upper, opposed side. However, in certain embodiments the second land areas 112 will be larger and/or more closely spaced than the opposed first land areas and the second open areas 116 will have an area and dimensions smaller than that of the first open areas and, in certain embodiments, may be more numerous than that of the first openings.

Extending between the first and second major outer surfaces 101 and 111 is the interior area 121 of the forming fabric 100. The interior area 121 of the forming fabric 100 is predominantly open. Extending between the first and second land areas 102, 112 and first and second major outer surfaces are third filaments 124. The third filaments can extend downwardly from the first land areas at an angle, relative to the plane of the first land area, between 45° and 135° or between about 50° and 130° or even between about 55° and 125°. In certain embodiments, third filaments adjacent the open areas extend at an obtuse angle towards and under the open areas (as measured from the plane of the first major surface and from the side of the filament opposite the open area). The third filaments 124 define a recess within the interior of the forming fabric, the recesses extending from the first open areas 106 defined by the first land areas 112 and into the interior 121 of the forming fabric 100.

In view of the relatively small widths of the first land areas and the angled orientation of the third filaments, the third filaments will extend directly under at least a portion of and be visible from the first open areas. In this regard, the recesses formed within the interior of the forming fabric will be partially, substantially, or entirely, defined by the downwardly extending third filaments. In certain embodiments, the third filaments may be substantially uniformly oriented or angled in a single direction. In other embodiments, the third filaments can extend at different angles relative to the first land areas. For example, in reference to FIGS. 2A and 2B, the filaments, while bowed, extend substantially along the MD direction, such that the recess will extend slightly under a portion of the first land areas. The third filaments 124 can be the same as (i.e. continuations of) or distinct from the first and second filaments 104, 114 forming the first and second land areas. In reference to the embodiments depicted in FIG. 2, the third filaments are entwined with the first and second filaments and form part of the first and second land areas.

Figure 3A:
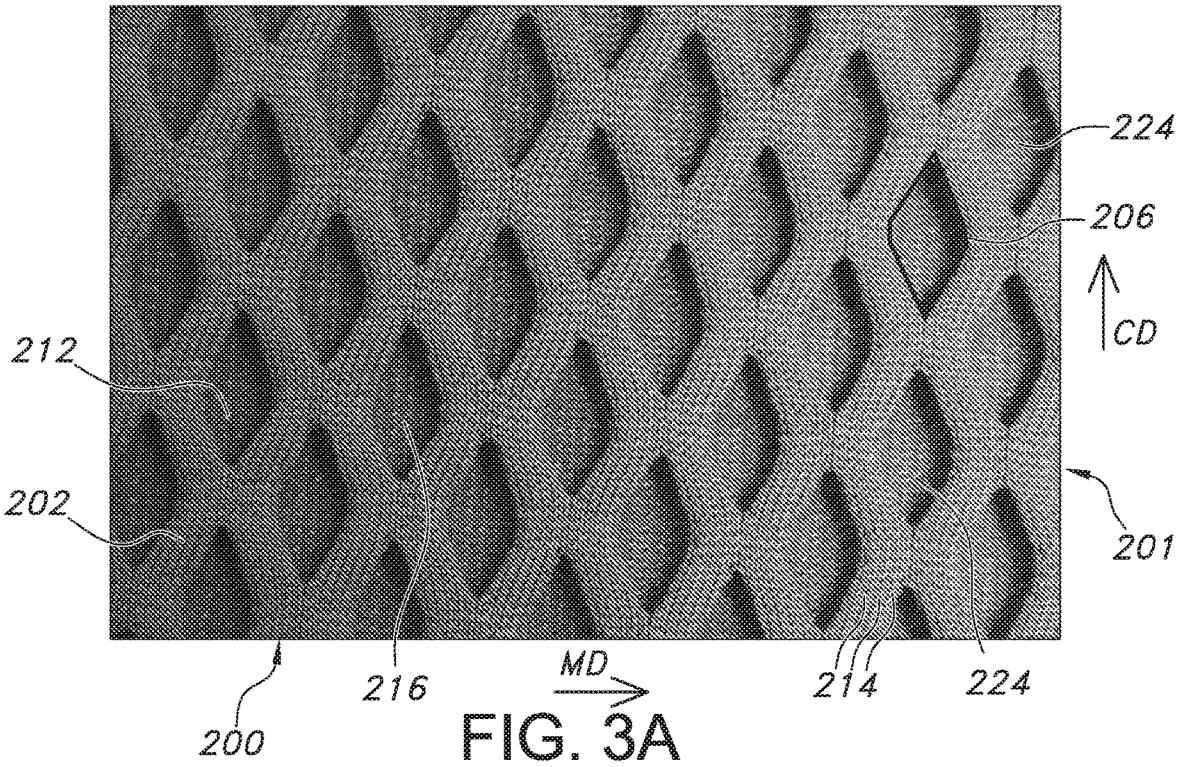
FIG. 3A is a top view of a forming fabric suitable for use in the present invention.
Figure 3B:
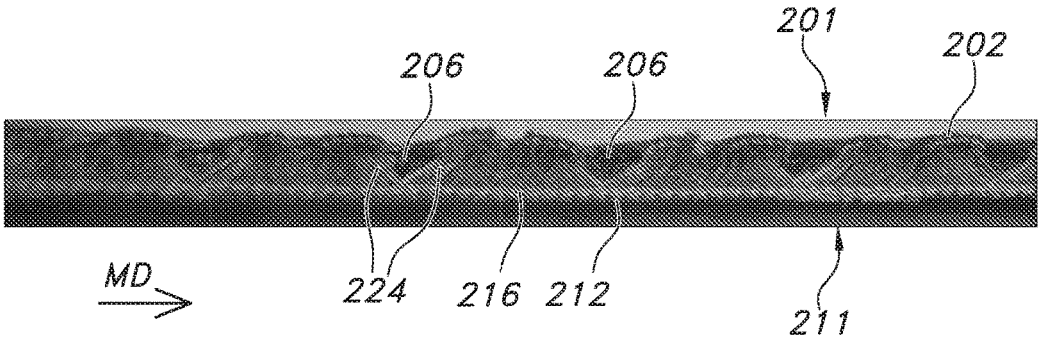
FIG. 3B is side view of the forming fabric of FIG. 3A.
Figure 3C:
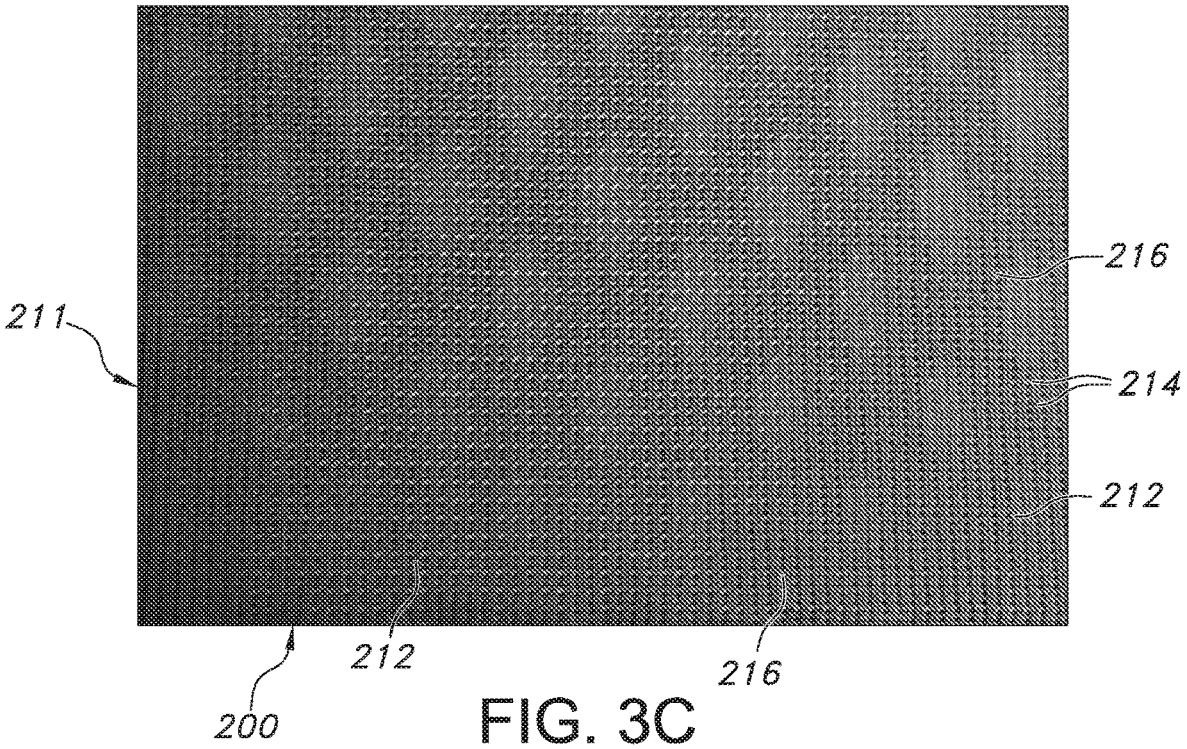
FIG. 3C is a bottom view of the forming fabric of FIG. 3A.

In a further embodiment and in reference to FIGS. 3A, 3B and 3C, a forming fabric 200 is provided having a first major outer surface 201 having first land areas 202 and first open areas 206. The first land areas 202 are formed by entwined filaments 204, such filaments having a knitted configuration. The land areas 202 define first openings 206 having a generally diamond-like shape. The opposing second major surface 211 having second land areas 212 formed by entwined second filaments 214, such filaments also having a knitted configuration. The second land areas 212 comprise a significantly larger percentage of the second major outer surface 211 relative to the first land areas 202 of the first major outer surface 201. In this regard, the open areas 216 of the second major outer surface are considerably smaller and of higher frequency than the first open areas 206 in the opposed first major outer surface 201. As best seen in reference to FIGS. 3B and 3C, third filaments 224 extend downwardly from the first land areas 202 and are entwined with the second land areas 212 in the opposed surface. The third filaments 224 extend downwardly at different angles, namely those proximate the center of the land areas 202 extending substantially perpendicularly to the plane of the first land areas 202 whereas those adjacent the open areas 206 extend at angle inwardly towards and directly under the adjacent open area 206. Thus, the third filaments 224 extend under the openings 206 defining the recess that directly underlies the open areas. This provides a highly porous interior recess within the forming fabric that allows for both downwardly and sideward movement of air being pulled through the forming fabric as well as a gradually decreasing recess depth that can provide graduated support to fibers as they are deposited and better maintain the formation of an open web structure with sufficient fiber distribution so as to avoid materially weakened regions.

Figure 4A:
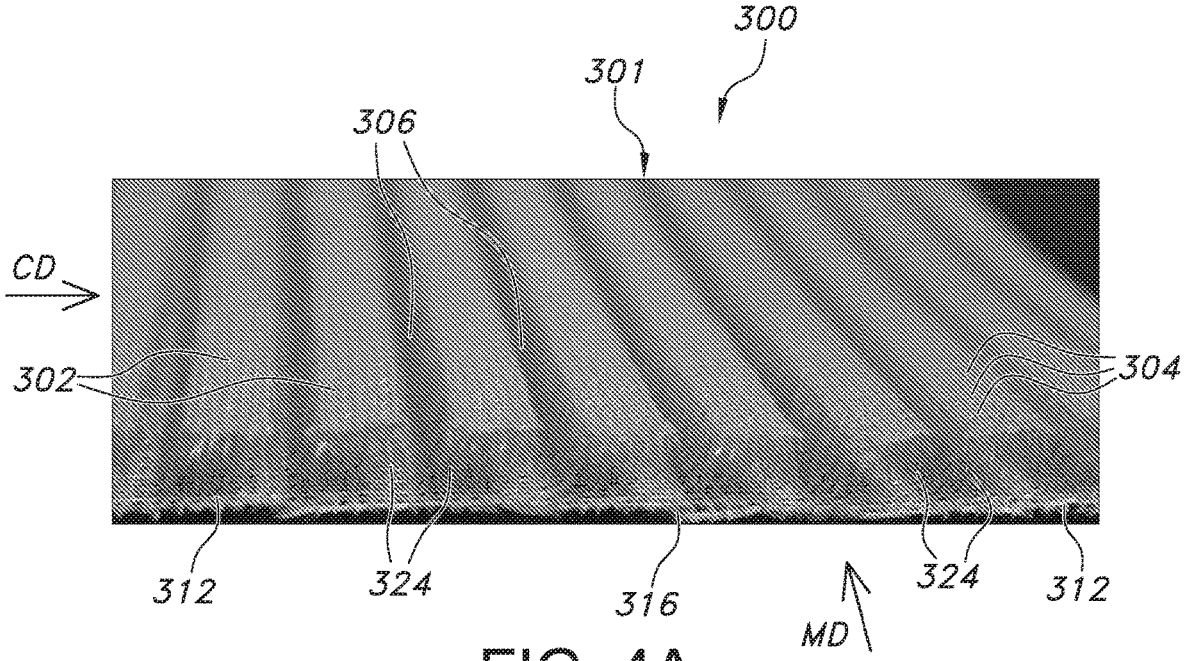
FIG. 4A is a partially elevated side view of a forming fabric suitable for use in the present invention.
Figure 4B:
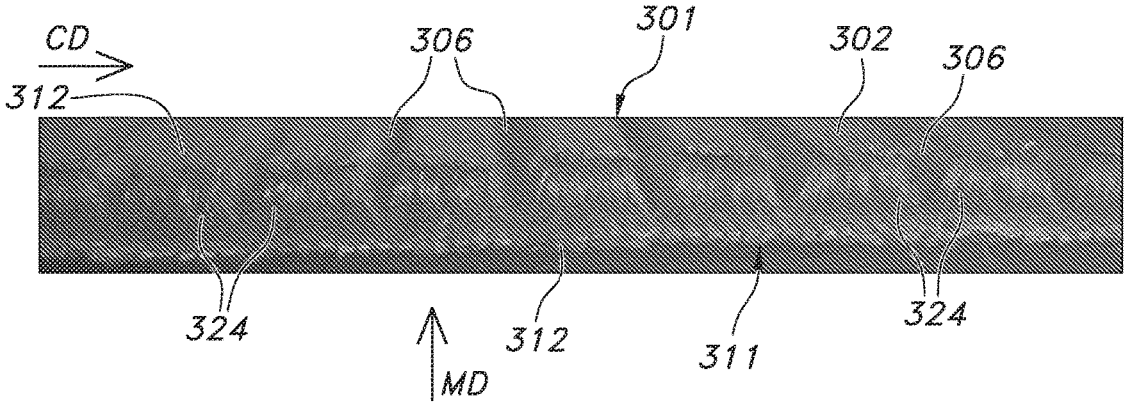
FIG. 4B is a side view of the forming fabric of FIG. 4A.
Figure 4C:
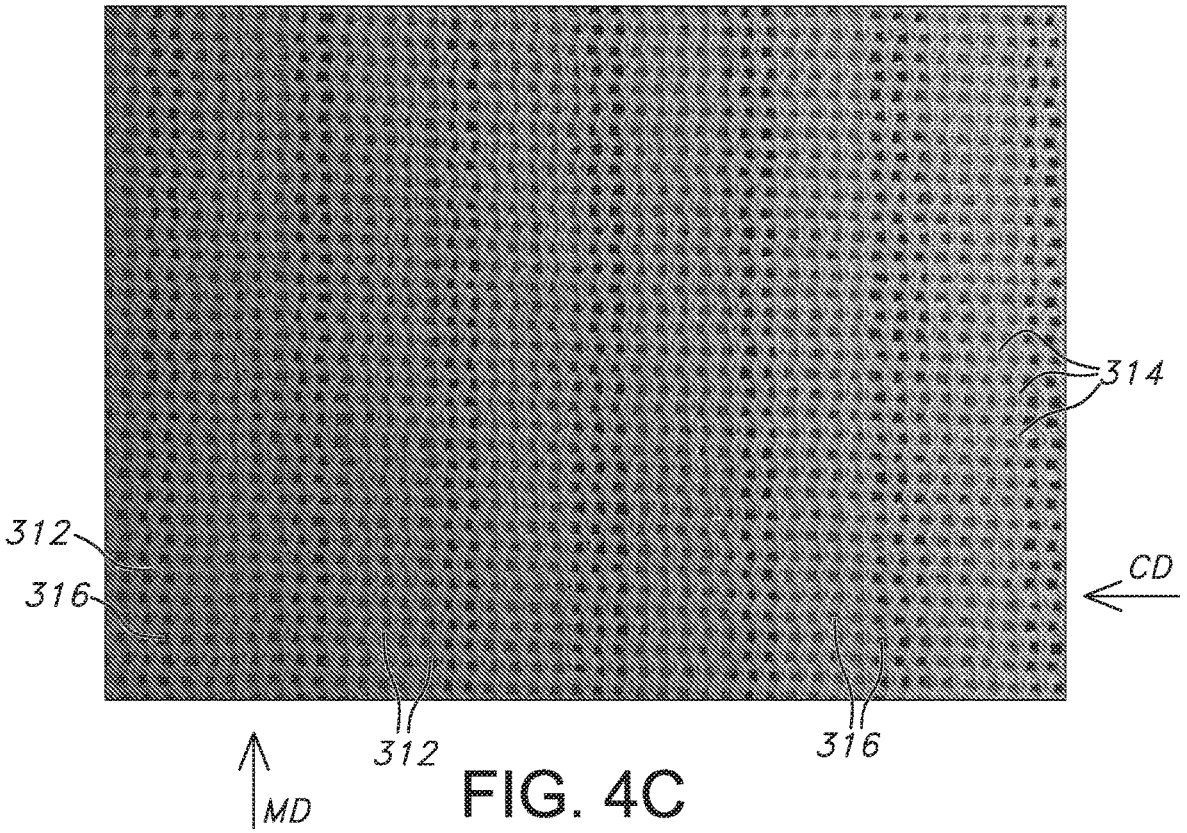
FIG. 4C is a bottom view of the forming fabric of FIG. 4A.
Figure 5A:
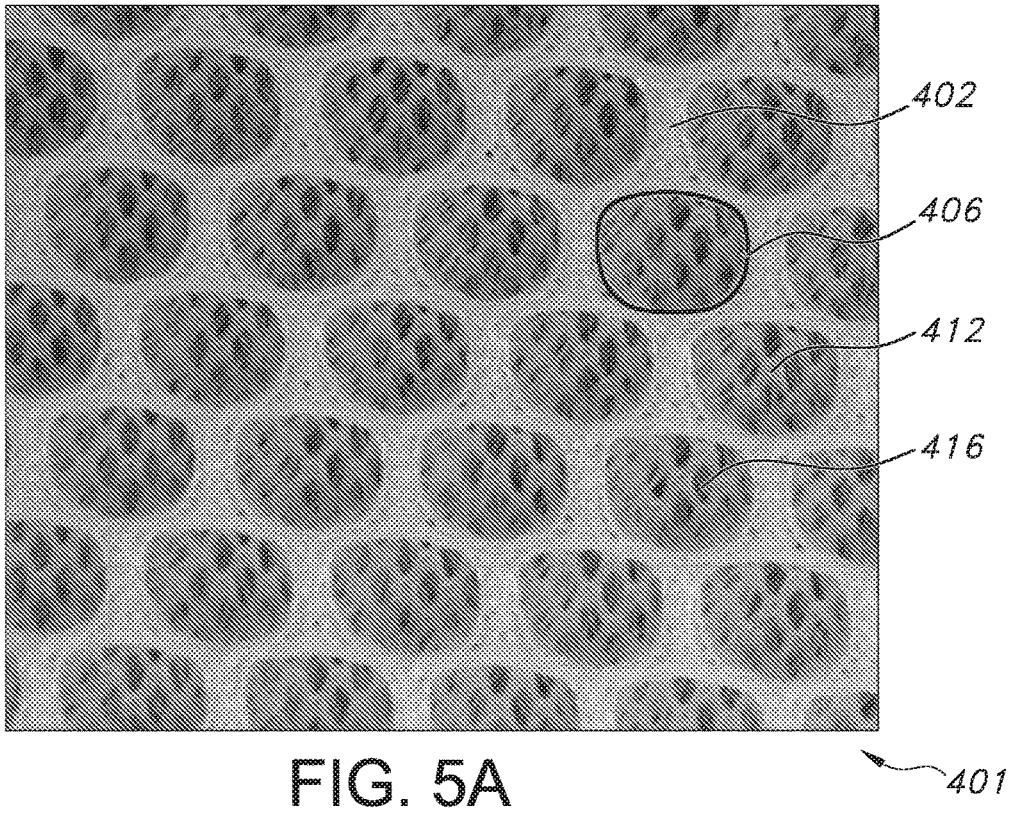
FIG. 5A is a top view of a forming fabric suitable for use in the present invention.
Figure 5B:
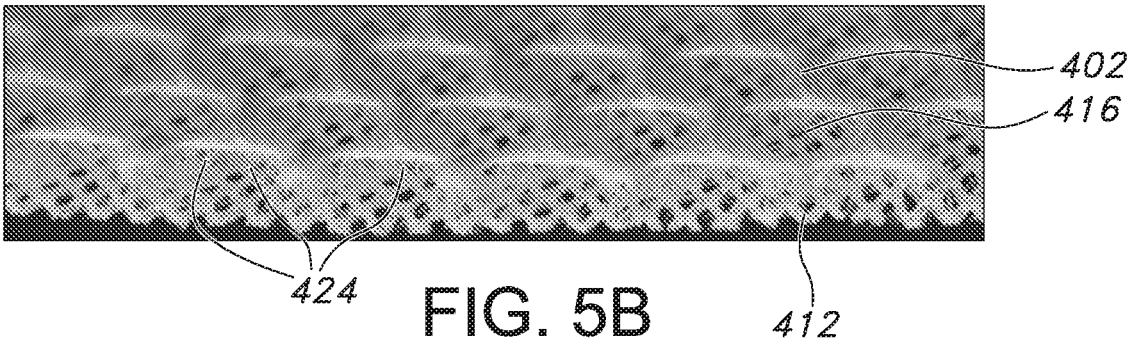
FIG. 5B a partially elevated side view of the forming fabric of FIG. 5A.
Figure 5C:
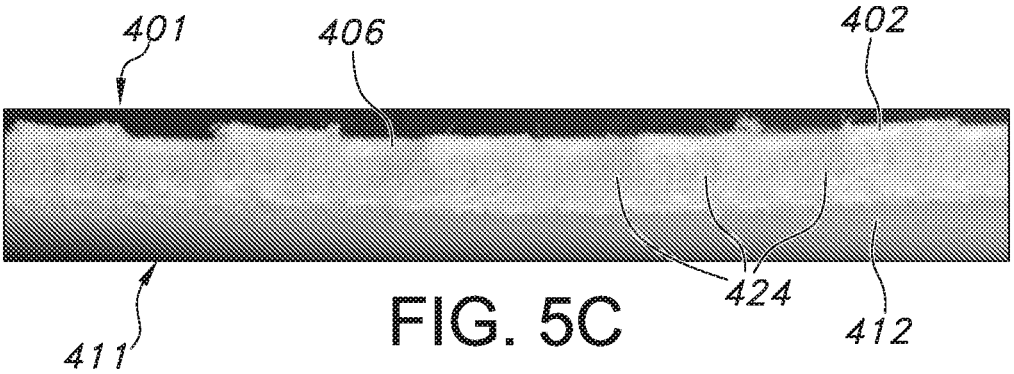
FIG. 5C is a side view of the forming fabric of FIG. 5A.
Figure 5D:
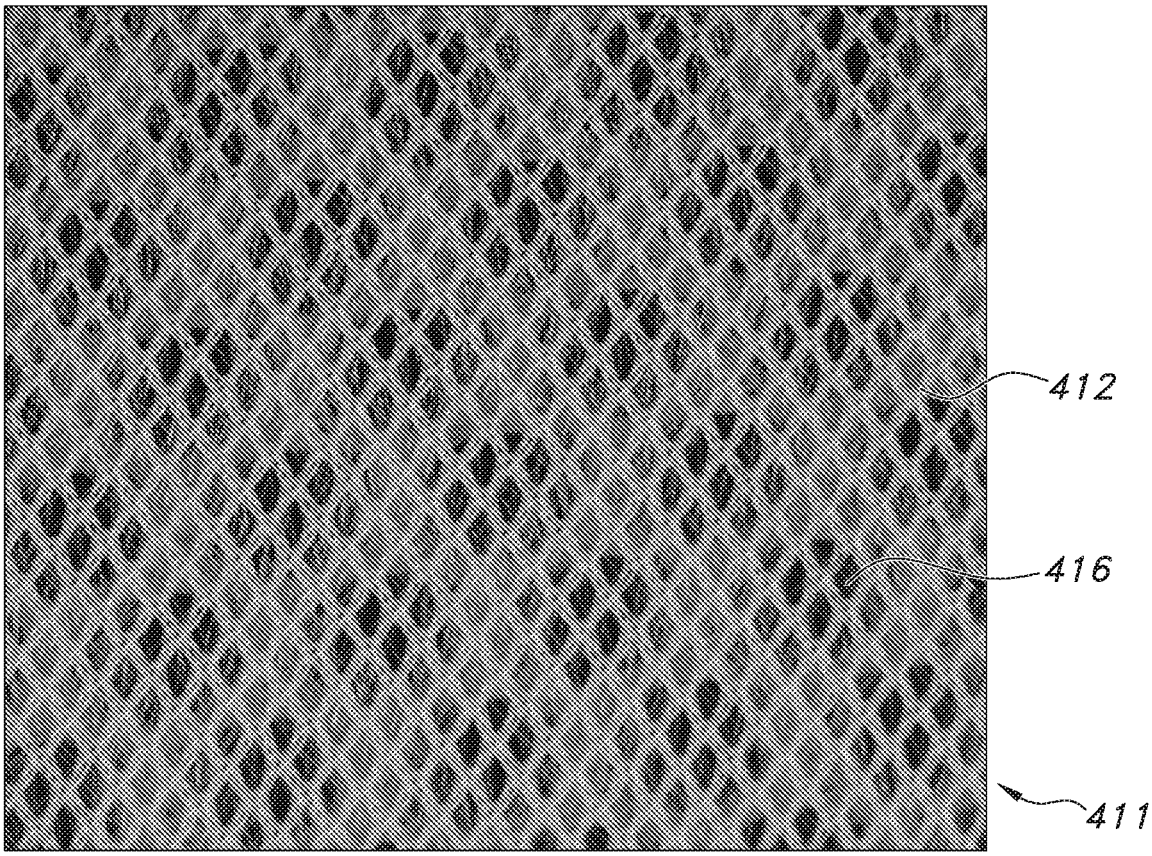
FIG. 5D is a bottom view of the forming fabric of FIG. 5A.

In a further embodiment and in reference to FIGS. 4A, 4B and 4C, a forming fabric 300 is provided having a first major outer surface 301 having first land areas 302 and first open areas 306. The first land areas 302 are formed by entwined filaments 304, such filaments having a knit configuration. The land areas 302 define first open areas 306 having a continuous columnar shape. In this regard, the first land areas 302 extend continuous in the MD and, unlike the prior embodiments lack land areas extending across the width of the CD and/or inter-connecting the MD extending segments. The opposing second major surface 311 has second land areas 312 formed by entwined second filaments 314, such filaments also having a knit configuration. The second land areas 312 comprise a significantly larger percentage of the second major outer surface 311 than the first land areas 302 of the first major outer surface 301. In this regard, the open areas 316 of the second major outer surface 311 are considerably smaller and of higher frequency than the first open areas 306 in the opposed first major outer surface 301. As best seen in reference to FIGS. 4A and 4B, the third filaments 324 extend downwardly from the first land areas 302 and are entwined with the second land areas 312 of the opposed surface. The third filaments 324 extend downwardly at different angles, namely those proximate the center of the land area 302 extending substantially perpendicularly to the plane of the first land areas 302 whereas those adjacent the open areas 306 extend at angle inwardly toward and under the open area 306. Thus, the third filaments 324 extend under the opening and define substantially the entire portion of the recesses that directly underlay the open areas 306. This provides a highly porous interior recess within the forming fabric that, as noted above, allows for both downward and sideward movement of air within the interior of the forming fabric as it is being pulled through the forming fabric. Similarly, it presents a gradually decreasing recess depth that can provide graduated support to fibers as they are deposited over the forming fabric and generally conform to the forming fabric and recesses therein. The foraminous land areas also helps limit the disparity of the drawing forces across the forming fabric and increase the laydown and retention of fibers upon the land areas.

In a further embodiment and in reference to FIGS. 5A, 5B, 5C and 5D, a forming fabric 400 is provided having a first major outer surface 401 having first land areas 402 and first open areas 406. The land areas 402 define first open areas 406 and together they generally provide a honeycomb pattern. The opposing second major surface 411 has second land areas 412 formed by entwined second filaments 314. The second land areas 412 provide a finer structure having smaller widths and also providing open areas 416 having substantially smaller dimensions. In this regard, the open areas 416 of the second major outer surface 411 are considerably smaller and of higher frequency than the first open areas 406 in the opposed first major outer surface 401. As best seen in reference to FIGS. 5B and 5C, the third filaments 424 extend downwardly from the first land areas 402 and into the second land areas 412 of the opposed surface 411. The third filaments 424 adjacent the upper openings 406 extend downwardly at an obtuse angle (taking the larger of the two angles formed along the direction that the filament extends) and extend under the openings 406 and define substantially portion of the recesses that directly underlay the open areas 306.

The forming fabric filaments comprise polymers capable of forming filaments having relatively high melting points and tensile strength. Examples of suitable polymers include but are not limited to polyesters, polyamides and other filament forming polymers. The polymers forming the forming fabric filaments will desirably have a melting point significantly higher than at least the polymer forming an outer portion of the fibers to be deposited and treated thereon. In addition, the filaments have a diameter of at least about 0.01 mm and including for example diameter greater than about 0.01 mm, 0.05 mm, 0.08 mm, or even 0.1 mm and/or less than about 1 mm, 0.8 mm, 0.5 mm, 03 mm or even 0.25 mm. Further, the filaments forming the interior region of the forming fabric can extend independently between the opposed land areas, spaced apart from one another and/or without significantly touching one another, so as to provide a highly porous interior region. The forming fabric should also be highly porous having an air permeability greater than about 500 CFM. In certain embodiments the forming fabric can have an air permeability in excess of about 600 CFM, 750 CFM, 900 CFM or even 1000 CFM and/or have an air permeability less than about 2000 CFM, 1750 CFM or even 1600 CFM. In certain aspects, the filaments comprising the forming fabric may comprise monofilaments, yarns and/or combinations thereof. The thickness of the interior area, i.e. the distance (L) between the inner surfaces of the first and second land areas, is desirably greater than about 2.3 mm, 2.5 mm, 3 mm, 5 mm, 7 mm, 10 mm or even 15 mm and/or less than about 35 mm, 30 mm, 25 mm or even 20 mm. Further, the thickness of the upper and lower land areas will each have a thickness less than that of the interior region and still more desirably will each have a thickness less than about 50%, 40%, 35%, 30% or 25% of that of the interior area. The overall thickness of the forming fabric may be greater than about 2.5 mm, 3 mm, 5 mm, 7 mm, 10 mm or even 15 mm and/or less than about 35 mm, 30 mm, 25 mm or even 20 mm.

The nonwoven webs formed by the methods and systems described herein can achieve a unique combination of properties and structures. The nonwoven web will have autogenous fiber-to-fiber bonds distributed throughout thereby providing a shaped structure that can be resiliently compressible, i.e. capable of returning to the original shape after having been temporarily deformed in use. In addition, the resulting nonwoven webs will have a base plane or land areas generally corresponding to the forming fabric's land areas of the first major outer surface. The nonwoven webs will also have a series or pattern of projections generally corresponding to the open areas within the first major outer surface as well as the underlying recesses within the interior area. Thus, the land areas and projections can have dimensions the same as those listed above in relation to the corresponding elements of the forming fabric.

Figure 6A:
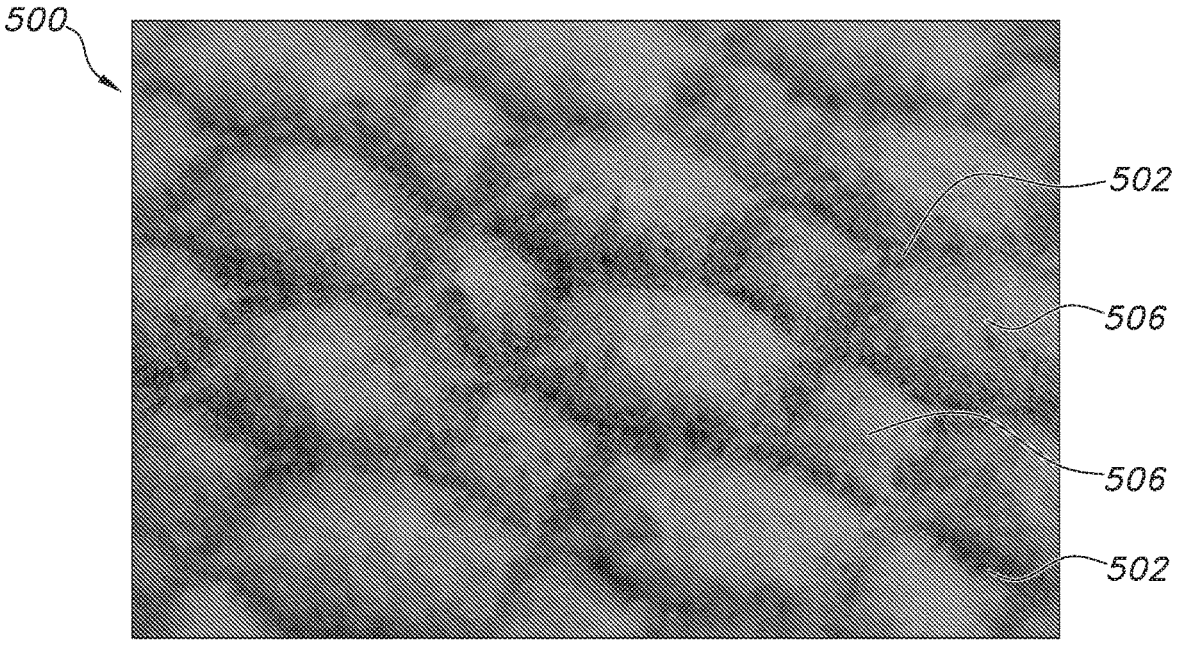
FIG. 6A is a perspective view of the fabric-side of a nonwoven web made using the forming fabric of FIG. 2.
Figure 6B:
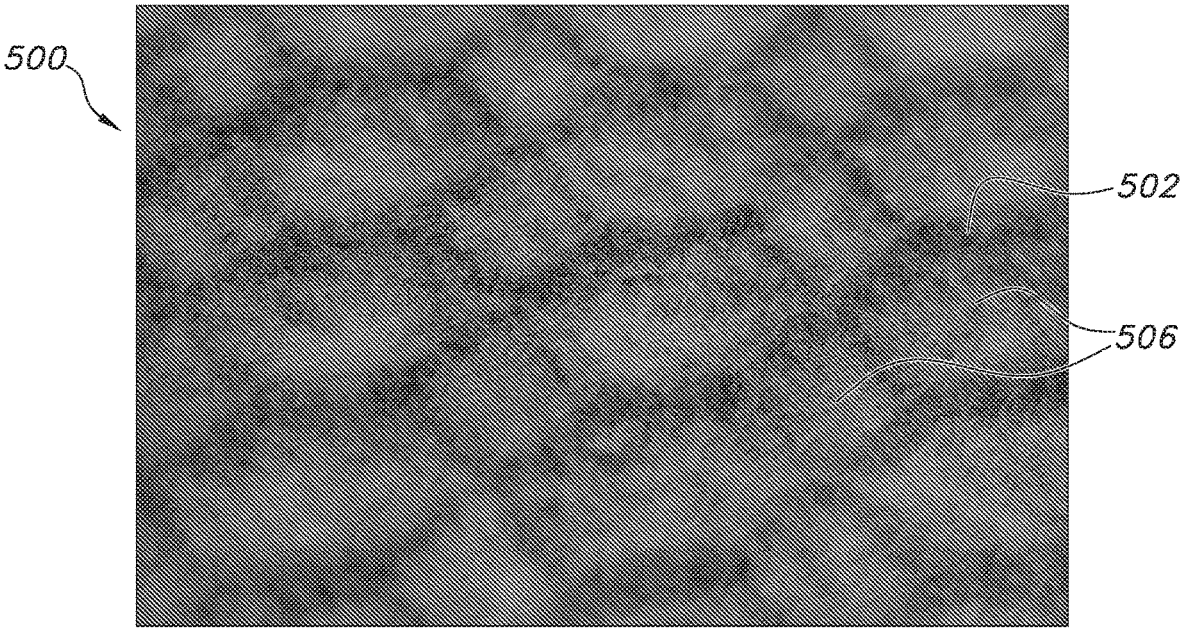
FIG. 6B is a perspective view of the air-side of the nonwoven web of FIG. 6A.

By way of example, a lofty nonwoven web made using the forming fabric as shown in FIGS. 2A-C is shown in FIGS. 6A and 6B. The side of the nonwoven web formed directly upon the forming fabric is referred to herein as the 'fabric side' and the side of the nonwoven web exposed to the air when formed is referred to as the 'air side.' The fabric side of the nonwoven web 500 is shown in FIG. 6A and has a pattern of large and small projections 506 extending above the land areas or base plane 502. The shape of the projections and land areas correspond to the openings 116A, 116B and land areas 102 of the forming fabric 100 as best seen in FIG. 2A. The projections have a height considerably greater than that of the base plane or land areas, however the fiber distribution is not excessively skewed since the underside of the projection, from the air-side, has a generally concave shape.

Figure 8A:
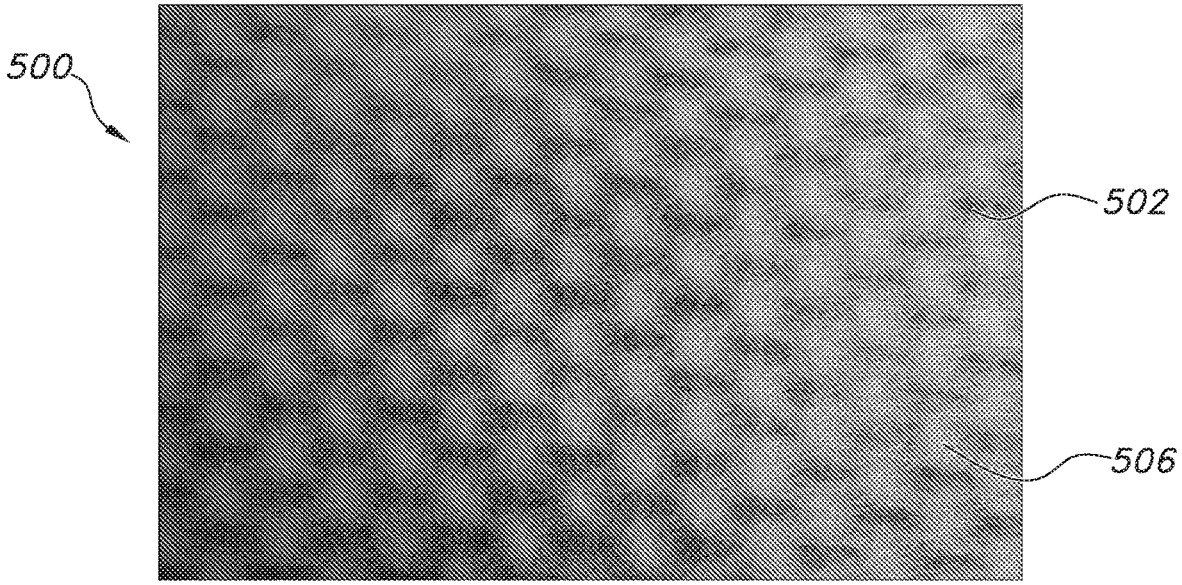
FIG. 8A is a perspective view of the fabric-side of a nonwoven web made using the forming fabric of FIG. 5.
Figure 8B:
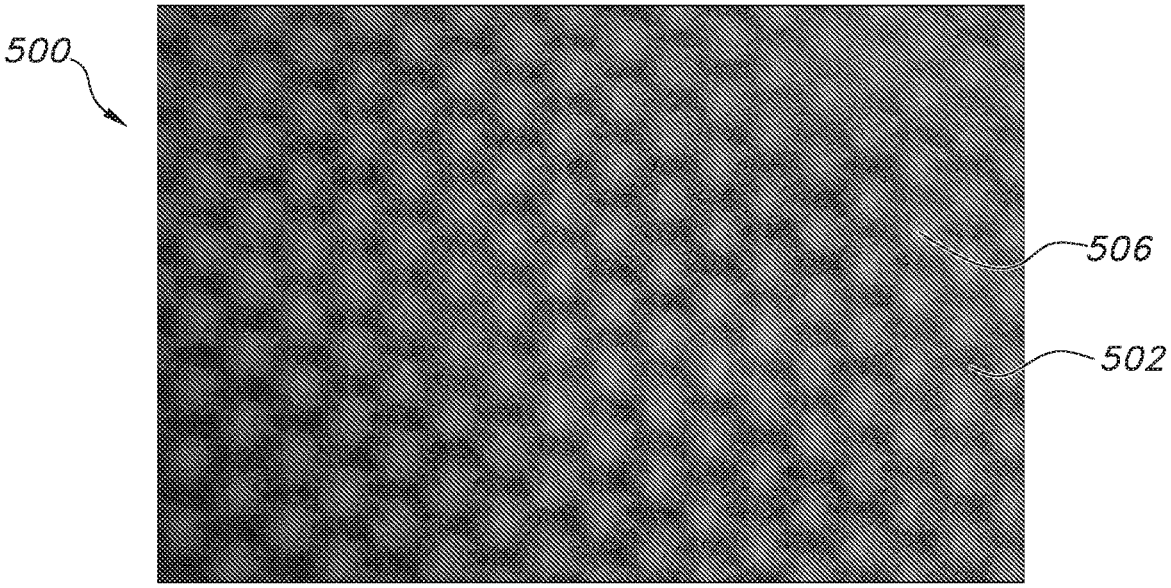
FIG. 8B is a perspective view of the air-side of the nonwoven web of FIG. 8A.

As a further example, the nonwoven web in FIGS. 8A and 8B was made using the forming fabric as shown in FIGS. 5A-D. The fabric side of the bonded nonwoven web 500 includes projections 506 of a size and shape corresponding to the openings 406 of the forming fabric 400 and also land areas 502 corresponding to the size and shape the land areas 402 of the forming fabric 400. In reference to the nonwoven shown in FIG. 8B, while the location of the protuberances can be seen through the web, the air-side of the nonwoven web presents a generally planer surface.

Figure 7A:
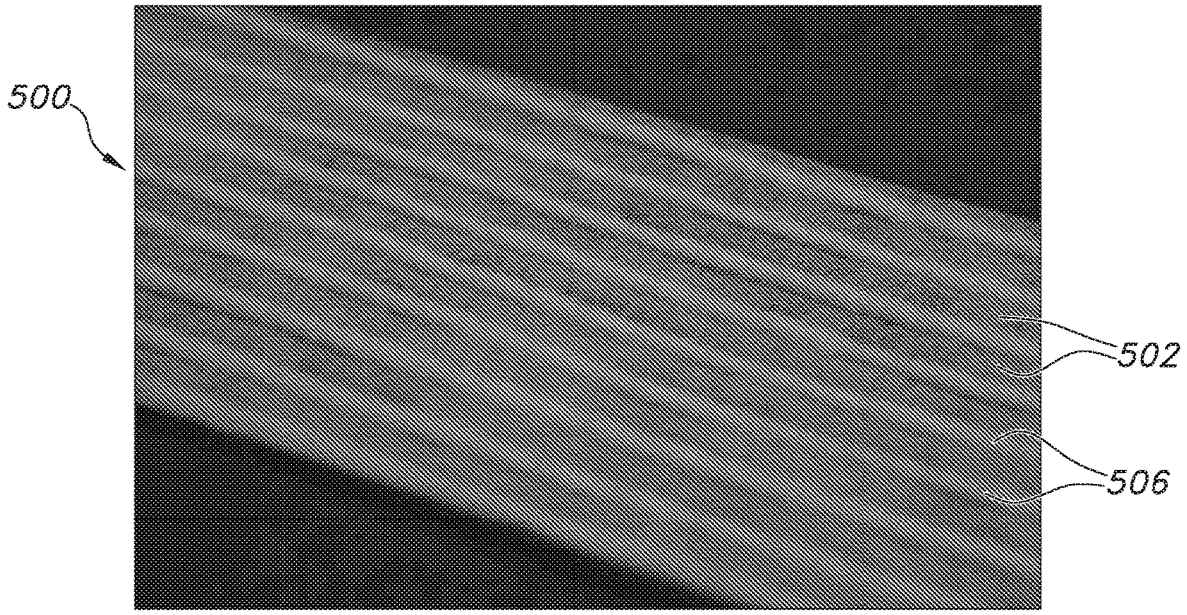
FIG. 7A is a perspective view of the fabric-side of a nonwoven web made using the forming fabric of FIG. 4.
Figure 7B:
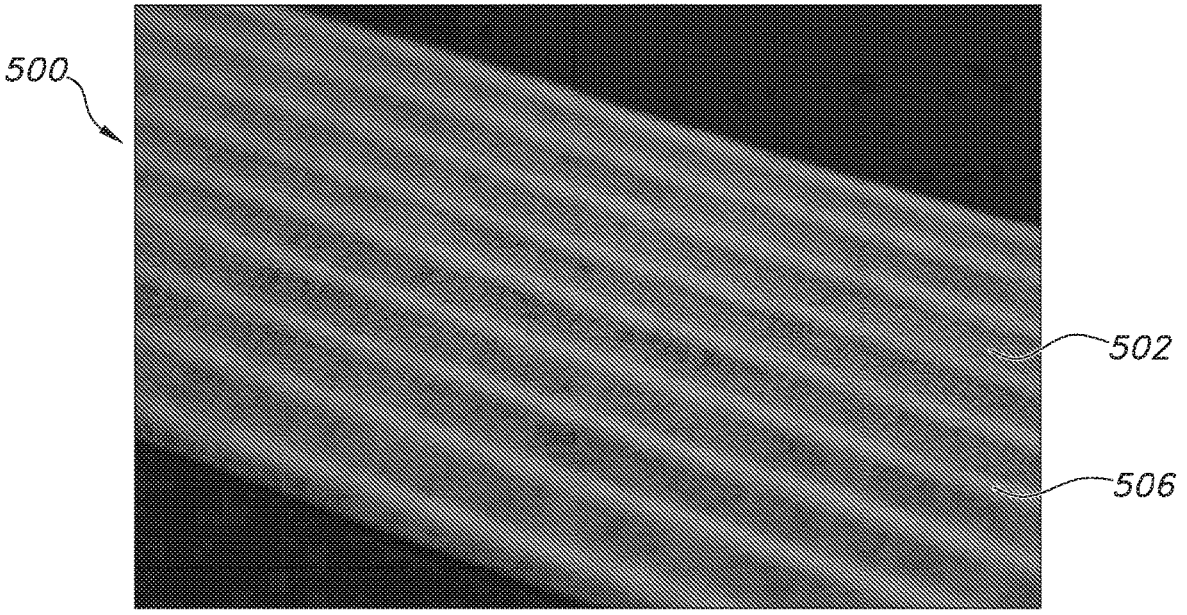
FIG. 7B is a perspective view of the air-side of the nonwoven web of FIG. 7A.

As a further example, a bonded nonwoven web was made using the forming fabric as shown in FIGS. 4A-C and the resulting nonwoven web is shown in FIGS. 7A and 7B. In this particular embodiment, the bonded nonwoven web 500 is formed having low density projections 506 extending continuously in the MD and corresponding to the columnar shapes of the defined openings 306 of the forming fabric 300. The air-side of the nonwoven web as shown in FIG. 7B, is not flat as in other embodiments and presents small tufts extending upwardly from the air-side that are located directly under the projections. The nonwoven's fabric-side, FIG. 7A, presents projections 506 that are considerably larger in size and height than the opposed tufts.

In certain embodiments, the projections within the nonwoven web can comprise at least about 40%, 45%, 50%, 55%, 60% or even 65% of the nonwoven web and in a further aspect can comprise less than about 95%, 90% or even 85% of the nonwoven web. The projections can each occupy an area greater than about 12 $mm^2$, 20 $mm^2$, 40 $mm^2$, 50 $mm^2$, 75 $mm^2$ or even 100 $mm^2$ and/or occupy an area less than about 2000 $mm^2$, 1500 $mm^2$, 1000 $mm^2$, 750 $mm^2$ or even 500 $mm^2$. Further, in certain embodiments, the smallest dimension of a projection can be between about 3 and about 60 mm, between about 5 and about 55 mm, between about 8 and about 50 mm, between about 10 and about 45 mm or between about 15 and about 40 mm. The projections can have an average height of between about 1 mm and about 8 mm, between about 2 mm and about 7 mm, between about 2 mm and about 6 mm, or between about 3 mm and about 5 mm. Further, the projections can have an average thickness of between about 1 mm and about 7 mm, between about 2 mm and about 7 mm, between about 2.5 mm and about 6 mm, or between about 3 mm and about 5 mm.

In addition, the land areas or base plane of the web can comprise at least about 5%, 10%, or 15% of the nonwoven web and/or can comprise less than about 60%, 55%, 50%, 45%, 40% or even 35% of the nonwoven web. Further, the base plane can have an average width (as defined between immediately adjacent projections) greater than about 0.8 mm, 1 mm, 1.5 mm or even 2 mm and/or less than about 9 mm, 8 mm, 7 mm or even 6 mm. The present invention allows, advantageously, utilizing a high degree of open area in the forming fabric which results in a corresponding high percentage of shaped elements in the nonwoven fabrics formed thereon. The base plane or land areas can have an average thickness of at least about 0.5 mm such as, for example, being between about 0.5 mm and about 3 mm, between about 0.5 and about 2.5 mm, 0.5 and about 2 mm, 0.5 mm and about 1.8 mm.

The bonded nonwoven web can have a basis weight less than about 240 g/m$^2$. In certain embodiments, the nonwoven webs can have a basis weight less than about 150 g/m$^2$, 120 g/m$^2$, 100, 90 g/m$^2$, 60 g/m$^2$, 45 g/m$^2$, 35 g/m$^2$, or 25 g/m$^2$ and further, in certain embodiments, can have a basis weight in excess of about 8 g/m$^2$, 10 g/m$^2$, 12 g/m$^2$ or 15 g/m$^2$. Despite forming the projections at the time of forming the web itself, the nonwoven web can have improved fiber distribution. In this regard, the average regional basis weight of the projections to that of the land areas can be between about 2.1:1 and about 1.2:1, between about 2:0:1 and about 1.3:1, between about 1.9:1 and about 1.3:1, or between about 1.8:1 and about 1.5:1.

The openness of the forming fabric and graduated support also promotes the formation of projections having a very soft and open structure. In this regard, a projection is formed having fibers distributed more evenly throughout the z-direction (i.e. the direction perpendicular to the MD and CD). The projections of the nonwoven webs of the present invention can have a density less than about 0.04 g/cc, 0.035 g/cc, 0.03 g/cm$^3$ (g/cc), 0.029 g/cc, 0.028 g/cc, 0.025 g/cc. 0.023 g/cc, 0.020 g/cc, or 0.019 g/cc. Further, the projections of the nonwoven webs can have a density greater than about 0.008 g/cc, 0.009 g/cc, 0.001 g/cc or 0.014 g/cc.

Still further, the unique forming surface and open fibrous structure further provides the formation of a web with increased normalized surface area, i.e. increased surface area per unit area. In this regard, the fabric side of the nonwoven webs of the present invention can have a normalized surface area greater than about 2, 3, 4, 5 or 7 and in certain embodiments can have a normalized surface area less than about 20, 18, 15 or 12.

After the formation of inter-fiber bonds, the nonwoven web may then be removed from the forming structure. Once removed from the forming structure, the coherent nonwoven web may be wound onto a winding roll or directed to undergo further processes and/or treatment. If desired, the nonwoven web may also be further treated by one or more techniques as is known in the art. In certain embodiments the fibrous sheets may, optionally, be treated by various other known techniques such as, for example, stretching, needling, creping, and so forth. In still further embodiments, the coherent nonwoven web may optionally be applied with one or more topical treatments or applications in order to enhance the surface properties of the nonwoven. For example, the nonwoven web may be treated with surfactants, detergents, anti-static, sequestrants, plasma fields (e.g. to improve wettability), electric fields (e.g. to form electrets), solvents, anti-microbial agents, pH modifiers, binders, fragrances, inks and so forth. Still further, the nonwoven web may optionally be plied with one or more additional materials or fabrics to form a multi-layer laminate.

One skilled in the art will appreciate that the shaped nonwovens made according to the present invention can be used in absorbent personal care articles including, for example, diapers, adult incontinence garments, incontinence pads/liners, sanitary napkins, panty-liners and so forth. In this regard, absorbent personal care articles commonly include a liquid-impervious outer cover, a liquid permeable topsheet positioned in facing relation to the outer cover, and an absorbent core between the outer cover and topsheet. Further, absorbent personal care articles also commonly include one or more liquid transfer layers position either between the topsheet and absorbent or between the outer cover and absorbent core. The unique nonwoven webs made and provide herein are well suited for use as or as a component of the topsheet, absorbent core, intermediate liquid transfer layers or as a facing material for an outer cover. By way of example only, various personal care absorbent articles are described in U.S. Pat. No. 4,701,177 to Ellis et al., U.S. Pat. No. 5,364,382 to Latimer et al., U.S. Pat. No. 5,415,640 to Kirby et al., U.S. Pat. No. 8,986,273 to Mercer et al.; US2014/0121621 to Kirby et al. In a further aspect, the shaped nonwoven webs provided herein may also be used as a wiper including for example wet or dry hard-surface wiper or personal care wiper including for example baby wipes. In addition, other articles that may include and employ the shaped nonwovens provided herein include, but are not limited to, baby bibs and changing pads, bed pads, food tray liners, sweat pads, bandages, protective apparel, air filters, mops and so forth.

Test Methods

As used herein air permeability is determined using a TEXTEST FX 3300 Air Permeability Tester from Textest AG using a test pressure of 125 Pa and a test head area of 38 cm$^2$.

The thickness or height of the projection or base plane regions of the nonwoven web is determined using calipers; the average is obtained by measuring 15 specimens of the applicable region. For high loft materials cutting of the nonwoven web typically will compress the adjacent material to some degree and thus where specimens are to be cut and removed from the larger web they are cut sufficiently distal to the point of measurement to ensure that the web is not compressed by the cutting action. The height measures the distance between the peak and bottom of the base plane and the thickness measures the actual dimension as measured between the air-side and fabric-side surface at the selected location. With respect to the projections, measurements are taken at the highest point, typically at the center of the projection. The pressure is applied by the calipers is only that sufficient to hold the specimen in place within the calipers, and without significant compression of the specimen.

The basis weight of the projections and base plane regions is determined by the method below. Fifteen circular specimens of a size slightly smaller than the applicable region are cut out of each of the respective regions of the bonded nonwoven web. The mass of each specimen is measured. The measured mass is divided by the area to obtain a basis weight.

The density is calculated from the average of 15 specimens. The selected regions are first measured for thickness in the manner provided above. The specimens cut out of the nonwoven for determining basis weight will be centered on the place where the height measurement was taken. The height, area and basis of the specimen is then used to calculate the density.

The normalized surface area as used herein refers to the measure of the surface area/area and is calculated from the average of 15 samples. A sample is cut having an area of 725 mm$^2$ and is scanned using a Keyence VK-X 100 3D Laser Scanning Confocal Microscope (3DLSCM) and Keyence VK Viewer version 2.8.0.0 software. The area scan is performed by stitching together a 9×9 matrix of scans taken using the 2.5× objective lens. The full z-axis range for this objective (−7 mm) is scanned with a z-axis step size of 0.048 mm. The scan data was analyzed using Keyence MultiFile Analyzer version 1.3.0.116 software. For each sample, image processing consisted of establishing a reference plane using a linear profile followed by a "strong" height cut to eliminate noise from the data. Feature volume and area information is calculated for each sample using the volume & area function of the software.

EXAMPLES

With respect to the examples below, crimped side-by-side polyethylene/polypropylene bicomponent spunbond fibers were made in accordance with U.S. Pat. No. 5,382,400 to Pike et al. The applicable forming fabric was attached to the traditional circumrotated forming wire. The bicomponent spunbond fibers were deposited on the forming fabric with the aid of a vacuum placed underneath the forming fabric. While on the forming fabric, the deposited bicomponent spunbond fibers were passed under a high-speed through-air bonder such as described in U.S. Pat. No. 5,707,468 to Arnold et al., thereby forming a coherent nonwoven web. The nonwoven web was subsequently further heated and autogenously bonded by a through-air bonder to further increase the degree of bonding as between adjacent bicomponent fibers.

Example 1

The nonwoven web of Example 1 was made using a dual bank spunbond process and the forming fabric as shown in FIGS. 2A-C. The resulting nonwoven web being shown in FIGS. 6A and 6B. The larger open areas 106A had a MD dimension of 24 mm, a CD dimension of 14 mm and the smaller open areas 106B had a MD dimension of 14 mm and a CD dimension of 12 mm. The forming fabric had a total height of 20 mm. In this example, the second through-air bonding step web was conducted on the nonwoven web while in the forming fabric. The second through-air bonding step was conducted while the nonwoven web was conducted prior to removing the nonwoven web from the forming fabric. The resulting nonwoven web had a basis weight of 55 g/M$^2$ whereas the projections had an average basis weight of 67 g/M$^2$ and the land areas had an average basis weight of 30 g/M$^2$. The projections had an average height of 6.4 mm, an average thickness of 6 mm and an average density of 0.015 g/cc. Further, the nonwoven web had a normalized surface area (SA/A) of 10.4.

Example 2

The nonwoven web of Example 2 was made using a single bank spunbond process and the forming fabric as shown in FIGS. 5A-D; the resulting nonwoven web being shown in FIGS. 8A and 8B. The larger open areas 406 had a MD dimension of 5 mm, a CD dimension of 7 mm and the forming fabric had a total height of 3 mm. In this example, the second through-air bonding step web was conducted after the nonwoven web had been removed from the forming fabric and was supported by a conventional wire. In this example, the second through-air bonding step web was conducted after the nonwoven web had been removed from the forming fabric and was supported by a conventional wire. As shown in reference to FIGS. 8A and 8B, a nonwoven web is formed having low density projections corresponding to the shapes of the defined open areas 406 and recesses within the forming fabric 400. The fabric-side of the nonwoven web, FIG. 8A, presents a generally planer section (corresponding to the first land areas of the forming fabric) with numerous discrete projections extending therefrom. The air-side of the nonwoven web, FIG. 8B, provides a general flat, planar material. The resulting nonwoven web had a basis weight of 55 g/M$^2$ whereas the projections had an average basis weight of 79 g/M$^2$ and the land areas had an average basis weight of 31 g/M$^2$. The projections had an average height of 1.9 mm and an average thickness of 1.9 mm. Further, the nonwoven web had a normalized surface area (SA/A) of 1.3.

Comparative Example 3

A non-planar nonwoven web was made using a dual bank spunbond process and a rubber matt having a pattern of circular apertures therein. The apertures had a diameter of 8.3 mm and had an edge-to-edge spacing of 9 mm in the MD, 9 mm in the CD and 4 mm in the diagonal. The rubber matt had a thickness of 3 mm. In this example, the second through-air bonding step was conducted while the nonwoven web was conducted prior to removing the nonwoven web from the forming fabric. A nonwoven web was formed having projections corresponding to the apertures within the matt. The resulting nonwoven web had a basis weight of 55 g/M$^2$ whereas the projections had an average basis weight of 101 g/M$^2$ and the land areas had an average basis weight of 28 g/M$^2$. The projections had an average height of 3.6 mm, an average thickness of 3.6 mm and an average density of 0.03 g/cc. The bonded nonwoven web had a normalized surface area (SA/A) of 1.6.

Comparative Example 4

A non-planar nonwoven web was made using a single bank spunbond process and rubber matt having a pattern of 5.5 mm diameter circular apertures therein. The rubber matt had a thickness of 3 mm and the apertures had an edge-to-edge spacing of 12 mm in the MD, 12 mm in the CD and 7 mm in the diagonal. In this example, the second through-air bonding step web was conducted after the nonwoven web had been removed from the forming fabric and was supported by a conventional wire. A nonwoven web was formed having projections corresponding to the apertures within the matt. The resulting nonwoven web had a basis weight of g/M$^2$ whereas the projections had an average basis weight of 112 g/M$^2$ and the land areas had an average basis weight of 24 g/M$^2$. The projections had an average height of 1.8 mm, an average thickness of 1.8 mm and an average density of 0.06 g/cc. The nonwoven web had a normalized surface area (SA/A) of 1.6.

The nonwovens described herein and methods of making the same can, optionally, include one or more additional elements or components as are known in the art. Thus, while the invention has been described in detail with respect to specific embodiments and/or examples thereof, it will be apparent to those skilled in the art that various alterations, modifications and other changes may be made to the invention without departing from the spirit and scope of the same. It is therefore intended that the claims cover or encompass all such modifications, alterations and/or changes.

What is claimed is:

1. A method of making a nonwoven fabric comprising:

providing a fibrous forming fabric having an air porosity of at least 500 CFM and having (a) a first major outer surface including first land areas formed from entwined first filaments and that extend predominantly in a first plane, wherein said first land areas define a plurality of first openings each having a minimum area in said first plane of at least 12 $mm^2$ and collectively comprising at least 40% of the total area of said first major outer surface;

(b) an opposed second major outer surface distal to the first major outer surface, said second major outer surface including second land areas formed from entwined second filaments and that extend predominantly in a second plane substantially parallel to the first plane; and (c) a foraminous interior area located between said first and second land areas, said interior area having a thickness greater than 2.3 mm and further having third filaments extending downwardly from said first land areas to said second land areas, said third filaments being entwined with said first filaments in said first land areas and said second filaments in said second land areas and further wherein at least some of the third filaments extend downwardly adjacent said first openings and at least partially define recesses located between said first and second land areas and further wherein the interior area allows air to flow both downwardly and sidewardly therethrough;

circumrotating said fibrous forming fabric;

entraining a plurality of continuous fibers in a stream of air;

suctioning said air through said fibrous forming fabric from adjacent said second major outer surface;

depositing said plurality of continuous fibers onto the first land areas of said fibrous forming fabric and onto the third filaments defining said recesses;

forming inter-fiber bonds between said plurality of continuous fibers thereby forming a non-planar nonwoven web;

removing the nonwoven web from the fibrous forming fabric; and wherein said third filaments proximate to centers of the first land areas extend substantially perpendicularly to the first plane and said third filaments adjacent respective first openings extend at an angle inwardly towards and directly under the respective first openings.

2. The method of claim 1 wherein said fibers comprise multicomponent fibers and wherein said inter-fiber bonds are formed by directing heated air through the forming fabric and fibers.

3. The method of claim 2 further comprising the step of activating a latent crimp within said fibers prior to removing said nonwoven web from said fibrous forming surface.

4. The method of claim 1 wherein the third filaments are discretely arranged and independently extend between the first and second land areas.

5. The method of claim 1 wherein said third filaments proximate to the first openings extend downwardly at an angle between 45° and 135° relative to the first plane and further wherein said third filaments extend directly under and are exposed by said first openings.

6. The method of claim 5 wherein said third filaments have an average diameter between about 0.1 mm and about 0.8 mm.

7. The method of claim 1 wherein said individual first openings have a surface area in the first plane of between about 20 and about 2000 $mm^2$.

8. The method of claim 7 wherein said first openings collectively comprise a surface area of between about 55% and about 95% of said first major outer surface.

9. The method of claim 1 wherein said interior area has a thickness greater than 3 mm.

10. The method of claim 1 wherein said first and second land areas are foraminous.

11. A method of making a nonwoven fabric comprising:

providing a fibrous forming fabric having an air porosity of at least 500 CFM and having (a) a first major outer surface including foraminous first land areas that extend predominantly in a first plane, wherein said first land areas define a plurality of first openings each having a minimum area in said first plane of at least 12 $mm^2$ and collectively comprising greater than 50% of the total area of said first major outer surface;

(b) an opposed second major outer surface distal to the first major outer surface, said second major outer surface including foraminous second land areas that define second openings; and (c) a foraminous interior area located between said first and second land areas, said interior area having a thickness of at least 2.3 mm and comprising individual interior filaments extending downwardly adjacent said first openings from said first land areas to said second land areas and wherein the interior filaments at least partially define recesses located between said first and second land areas and beneath the first openings, and further wherein air can travel both downwardly and sidewardly through the interior filaments;

circumrotating said fibrous forming fabric;

entraining a plurality of continuous fibers in a stream of air;

suctioning said air through said fibrous forming fabric wherein said suctioned air moves in a direction towards the first major surface, through the fibrous forming fabric and then away from the second major surface;

depositing said plurality of continuous fibers onto the first land areas of said fibrous forming fabric and into the interior filaments adjacent said recesses;

forming inter-fiber bonds between said plurality of continuous fibers thereby forming a bonded nonwoven web;

removing said bonded nonwoven web from said fibrous forming surface; and wherein said interior filaments proximate to centers of the first land areas extend substantially perpendicularly to the first plane and said interior filaments adjacent respective first openings extend at an angle inwardly towards and directly under the respective first openings.

12. The method of claim 11 wherein said fibers comprise multicomponent fibers and wherein said inter-fiber bonds are formed by through-air bonding.

13. The method of claim 12 wherein the interior filaments are discretely located between the first and second land areas.

14. The method of claim 11 wherein said individual first openings each occupy a surface area in the first pane of between about 20 and about 2000 $mm^2$.

15. The method of claim 11 wherein said interior filaments have an average diameter between 0.1 mm and 0.25 mm.

16. The method of claim 11 wherein said filaments extend downwardly at an obtuse angle relative to the first plane and extend under the majority of the area beneath the first openings.

17. The method of claim 11 wherein the interior area has a thickness, as measured between the first and second land areas, between 3 mm and about 35 mm.

18. The method of claim 11 wherein the first land areas comprise between about 5% and about 40% of the first major outer surface and the forming fabric.

19. The method of claim 11 wherein the first land areas extend continuously in the machine direction.

20. The method of claim 11 further comprising bonding said nonwoven web after said bonded nonwoven web has been removed from said forming fabric.

* * * * *